US009536538B2

(12) United States Patent
Joder et al.

(10) Patent No.: US 9,536,538 B2
(45) Date of Patent: Jan. 3, 2017

(54) METHOD AND DEVICE FOR RECONSTRUCTING A TARGET SIGNAL FROM A NOISY INPUT SIGNAL

(71) Applicant: Huawei Technologies Co., Ltd., Shenzhen (CN)

(72) Inventors: Cyril Joder, Munich (DE); Felix Weninger, Neu-Ulm (DE); Bjoern Schuller, Gilching (DE); David Virette, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 14/716,289

(22) Filed: May 19, 2015

(65) Prior Publication Data

US 2015/0262590 A1 Sep. 17, 2015

Related U.S. Application Data

(63) Continuation of application No. PCT/EP2012/073148, filed on Nov. 21, 2012.

(51) Int. Cl.
*G10L 21/0208* (2013.01)
*G10L 21/0216* (2013.01)
*G10L 21/0232* (2013.01)

(52) U.S. Cl.
CPC ..... *G10L 21/0208* (2013.01); *G10L 21/0216* (2013.01); *G10L 21/0232* (2013.01)

(58) Field of Classification Search
CPC ..... G10L 21/0208; G10L 21/0216
See application file for complete search history.

(56) References Cited

U.S. PATENT DOCUMENTS

| | | | | |
|---|---|---|---|---|
| 8,015,003 | B2 | 9/2011 | Wilson et al. | |
| 2004/0193411 | A1* | 9/2004 | Hui | G10L 15/20 704/233 |
| 2005/0222840 | A1 | 10/2005 | Smaragdis | |
| 2012/0185246 | A1* | 7/2012 | Zhang | G10L 21/0208 704/226 |
| 2012/0296643 | A1* | 11/2012 | Kristjansson | G10L 21/0208 704/226 |

OTHER PUBLICATIONS

Hansler, E., et al., "Acoustic Echo and Noise Control: A Practical Approach," 1st Edition, John Wiley & Sons, Inc., 2004, 478 pages.

(Continued)

*Primary Examiner* — Douglas Godbold
(74) *Attorney, Agent, or Firm* — Conley Rose, P.C.

(57) ABSTRACT

A method for reconstructing at least one target signal comprises determining a first set of feature vectors from the input signal, the first set of feature vectors forming a non-negative input matrix; determining a second set of feature vectors, the second set of feature vectors forming a non-negative noise matrix; decomposing the input matrix into a sum of a first matrix and a second matrix, the first matrix representing a product of a non-negative bases matrix and a non-negative weight matrix, and the second matrix representing a combination of the noise matrix and a noise weight vector; and reconstructing the at least one target signal based on the non-negative bases matrix and the non-negative weight matrix.

17 Claims, 5 Drawing Sheets

(56) References Cited

OTHER PUBLICATIONS

Mohammadiha, N., et al., "A New Linear Mmse Filter for Single Channel Speech Enhancement Based on Nonnegative Matrix Factorization," IEEE Workshop on Applications of Signal Processing to Audio and Acoustics, Oct. 16-19, 2011, pp. 45-48.
Berouti, M., et al., "Enhancement of Speech Corrupted by Acoustic Notice,", 1979, pp. 208-211.
Martin, R., et al., "Noise Power Spectral Density Estimation Based on Optimal Smoothing and minimum Statistics," IEEE Transactions on Speech and Audio Processing, vol. 9, No. 5, Jul. 2001, pp. 504-512.
Joder, C., et al., "Real-time Speech Separation by Semi-Supervised Nonnegative Matrix Factorization," Lecture Notes in Computer Science, vol. 7191, 2012, 1 page.
Wilson, K, et al., "Speech Denoising Using Nonnegative Matrix Factorization with Priors," ICASSP 2008, pp. 4029-4032.
Ephraim, Y., et al., "Speech Enhancement Using a Minimum Mean-Square Error Log-Spectral Amplitude Estimator," IEEE Transactions on Acoustics, Speech, and Signal Processing, vol. ASSP-33, No. 2, Apr. 1985, pp. 443-445.
Fan, N., et al., "Speech Noise Estimation Using Enhanced Minima Controlled Recursive Averaging," ICASSP, 2007, pp. 581-584.
Schmidt, M., et al., "Reduction of Non-Stationary Noise Using a Non-Negative Latent Variable Decomposition," IEEE Workshop on Machine Learning for Signal Processing, Oct. 16, 2008, pp. 486-491.
Sui, L., et al., "Speech Enhancement Based on Sparse Nonnegative Matrix Factorization with Priors," International Conference on Systems and Informatics, May 19, 2012, pp. 274-278.
Foreign Communication From a Counterpart Application, PCT Application No. PCT/EP2012/073148, English Translation of International Search Report dated Jan. 30, 2013, 5 pages.
Foreign Communication From a Counterpart Application, PCT Application No. PCT/EP2012/073148, English Translation of Written Opinion dated Jan. 30, 2013, 6 pages.

* cited by examiner

METHOD AND DEVICE FOR RECONSTRUCTING A TARGET SIGNAL FROM A NOISY INPUT SIGNAL

CROSS-REFERENCE TO RELATED APPLICATION

This application is a continuation of International Application No. PCT/EP2012/073148, filed on Nov. 21, 2012, which is hereby incorporated by reference in its entirety.

TECHNICAL FIELD

The present invention relates to a method and device for reconstructing a target signal from a noisy input signal. In particular, the present invention relates to the processing of an acoustic input signal to provide an output signal with reduced noise.

BACKGROUND

Reduction of acoustic noise is important in different fields, in particular for speech communication. For example, noise suppression in telephonic communications can be very beneficial if the telephony system is used in a noisy environment such as a car cabin or in the street. Noise reduction is crucial in hands-free telephony systems, where the noise level is usually higher because of the distance between the microphone(s) and the speaker(s). Furthermore, speech recognition systems, in which a device or a service is controlled by vocal commands, suffer a decrease of recognition rate when operated in noisy environments. Hence, the reduction of the noise level is also useful in order to improve the reliability of such systems.

Noise suppression in spoken communication, also called "speech enhancement", has received a large interest for more than three decades and many methods have been proposed to reduce the noise level in speech recordings. Most of these systems rely on the on-line estimation of a "background noise" which is assumed to be stationary, i.e. to change slowly over time. However, this assumption is not always verified in the case of a real noisy environment. Indeed, the passing by of a truck, the closing of a door or the operation of some kinds of machines such as a printer, are examples of non-stationary noises which can frequently occur.

Another technique, called Non-negative Matrix Factorisation (NMF) has recently been applied to this problem. This method is based on a decomposition of the power spectrogram of the mixture into a non-negative combination of several spectral bases, belonging to either the speech or the interfering noise. NMF methods have been used in that context with relatively good results. The basic principle of NMF-based audio processing 100 as schematically illustrated in FIG. 1 is to find a locally optimal factorization of a short-time magnitude spectrogram V 103 of an audio signal 101 into two factors W and H, of which the first one W represents the spectra of the events occurring in the signal 101 and the second one H their activation over time. The first factor W describes the component spectra of the source model 109. The second factor H describes the activations 107 of the signal spectrogram 103 of the audio signal 101. The first factor W and the second factor H are matched with the short-time magnitude spectrogram V 103 of the audio signal 101 by an optimization procedure. The source model 109 is pre-defined when applying supervised NMF and a joint estimation is applied for the source model 109 when using unsupervised NMF. The source signal or signals 113 can be derived from the source spectrogram 111. This approach has the advantage of using no stationarity assumption and gives good results in general.

However, the estimation of the noise components from the signal can be computationally intensive with the NMF technique. Furthermore, systems based on NMF do not take into account the fact that the noise, or a part of it, can be stationary. Hence, conventional noise estimators are often superior to NMF for capturing the stationary component of the background noise, while being less complex.

Common methods for noise reduction, often denoted as "speech enhancement", include for example spectral subtraction as described by M. Berouti, R. Schwartz and J. Makhoul: "Enhancement of Speech Corrupted by Acoustic Noise", Proc. IEEE ICASSP 1979, vol. 4, pp. 208-211, Wiener filtering as described by E. Hänsler, G. Schmidt, "Acoustic Echo and Noise Control", Wiley, Hoboken, N.J., USA, 2004 or so-called Minimum Mean-Square Error Log-Spectral Amplitude as described by Y. Ephraim, D. Malah: "Speech Enhancement Using a Minimum Mean-Square Error Log-Spectral Amplitude Estimator", IEEE Trans. Acoust., Speech and Signal Process., vol. 33, pp. 443-445, 1985. These techniques are all based on a prior estimation of the background noise power spectrum, which is then "removed" from the original signal. However, they also assume that the background noise can be reliably predicted from the recent past of the signal. Hence, these approaches do not well handle highly non-stationary noise types.

Noise power spectrum estimation methods involve, for example, the averaging of the short-time power spectrum in times frames where speech is absent according to a voice activity detector as shown by M. Berouti, R. Schwartz and J. Makhould: "Enhancement of Speech Corrupted by Acoustic Noise", Proc. IEEE ICASSP 1979, vol. 4, pp. 208-211, or the smoothing of the minimum value in each considered spectral band as shown by R. Martin, "Noise Power Spectral Density Estimation Based on Optimal Smoothing and Minimum Statistics", IEEE Trans. On Speech and Audio Process., vol. 9, n. 5, Jul. 2001. Other methods include the so-called minima-controlled recursive averaging as described by N. Fan, J. Rosca, R. Balan, "Speech Noise Estimation Using Enhanced Minima Controlled Recursive Averaging", Proc. IEEE ICASSP 2007, vol. 4, pp. 581-584 or NMF as described by N. Mohammadiha, T. Gerkmann, A. Leijon, "A New Linear MMSE Filter for Single Channel Speech Enhancement Based on Nonnegative Matrix Factorization", Proc. of the 2011 IEEE Workshop on Application of Signal Process. to Audio and Acoustics, pp. 45-48.

Recently, the NMF technique has been introduced for the direct reduction of noise in speech recordings from single-channel input. The conventional formulation of NMF is defined as follows. V is defined as a m×n matrix of non-negative real values. The goal is to approximate this matrix by the product of two other non-negative matrices $W \in \mathbb{R}_+^{m \times r}$ and $H \in \mathbb{R}_+^{r \times n}$, where $r \ll m, n$. In mathematical terms, a cost function, measuring the "reconstruction error" between V and W·H, is minimized.

When processing sounds, the input matrix V is given by the succession of short-time magnitude (or power) spectra of the input signal, each column of the matrix containing the values of the spectrum computed at a specific instance in time. These features are given by a short-time Fourier transform (STFT) of the input signal, after some window function is applied to it. This matrix contains only non-negative values, because of the kind of features used.

The NMF decomposition is illustrated in FIG. 2 by a simple example. The figure represents a spectrogram 201 represented by the matrix V, a matrix of two spectral bases 202 represented by the matrix W and the corresponding temporal weights 203 represented by the matrix H. The greyscale of the spectrogram 201 represents the amplitude of the Fourier coefficients. The spectrogram defines an acoustic scene which can be described as the superposition of two so called "atomic sounds". By applying a two-component NMF to this spectrogram, the matrices W and H as defined in FIG. 2 can be obtained. Each column of W can be interpreted as a basis function for the spectra contained in V, when weighted with the corresponding values of H.

Since all of these bases and weights are non-negative, they can be used to build two different spectrograms, each of them describing one of the "atomic sounds". Thus these sounds can be separated from the mixture, even though they sometimes appear at the same time in the original signal. The example of FIG. 2 is simplistic; however the NMF method can provide satisfactory results in separating different sound sources from realistic recordings. In these cases, a larger value of the order of decomposition r is used. Then, each "component", i.e. the product of one spectral basis with the corresponding temporal weights, is assigned to a specific source. The estimated spectrogram of each source is finally obtained by the sum of all the components attributed to the source.

The above described method has been applied to the separation of speech from noise as shown by K. W. Wilson, B. Raj, P. Smaragdis and A. Divakaran: "Speech Denoising using non-negative matrix factorization with priors" in IEEE Intern. Conf. on Acoustics, Speech and Signal Process., pp. 4029-4032, 2008. One of the advantages of this approach is that it can theoretically cope with any type of environment, including non-stationary noise. However, NMF can be computationally expensive, since it involves matrix multiplications. Furthermore, in the case of stationary noises, the conventional methods for noise spectral power estimation can outperform NMF, often with a very low computational cost.

SUMMARY

It is the object of the invention to provide a robust, low complexity noise reduction that can cope with both, stationary and non-stationary noise environments.

This object is achieved by the features of the independent claims. Further implementation forms are apparent from the dependent claims, the description and the figures.

The invention is based on the finding that noise reduction for stationary and non-stationary noise environments can be achieved by transforming an acoustic input signal into vectors of non-negative features, e.g. such as spectral magnitude, and estimating the feature vectors of the background stationary noise from the input feature set. Each feature vector is then factored as the product of a non-negative bases matrix and a vector of non-negative weights. It can be shown that one of the bases in the matrix is equal to the estimated background noise feature vector. The noise-reduced output signal can be represented by the combination of a subset of the bases of the matrix, weighted by the corresponding weights. Such technique works very robust and computationally efficient in both, stationary and non-stationary noise environments, as will be presented in the following.

The decomposition process is enhanced by integration of a stationary noise estimator, thereby providing an output signal with reduced noise.

In order to describe the invention in detail, the following terms, abbreviations and notations will be used:

Audio rendering: a reproduction technique capable of creating spatial sound fields in an extended area by means of loudspeakers or loudspeaker arrays, NMF: Non-negative matrix factorization, FNMF: Foreground Non-negative Matrix Factorization, MMSE-LSA: Minimum Mean-Square Error Log-Spectral Amplitude, Vector 1-norm: The vector 1-norm of an m times n matrix A is defined as the sum of the absolute values of its elements, $$\|A\|_1=\Sigma_{i=1}^{m}\Sigma_{j=1}^{n}|a_{i,j}|$$

Hadamard product: The Hadamard product is a binary operation that takes two matrices of the same dimensions, and produces another matrix where each element ij is the product of elements ij of the original two matrices.

According to a first aspect, the invention relates to a method for reconstructing at least one target signal from an input signal corrupted by noise, the method comprising determining a first set of feature vectors from the input signal, the first set of feature vectors forming a non-negative input matrix representing signal characteristics of the input signal; determining a second set of feature vectors from the first set of feature vectors, the second set of feature vectors forming a non-negative noise matrix representing noise characteristics of the input signal; decomposing the input matrix into a sum of a first matrix and a second matrix, the first matrix representing a product of a non-negative bases matrix and a non-negative weight matrix, and the second matrix representing a combination of the noise matrix and a noise weight vector; and reconstructing the at least one target signal based on the non-negative bases matrix and the non-negative weight matrix.

The method provides a hybrid approach that integrates a background noise estimator into the NMF framework. The estimated noise is considered as a special component in the NMF. That allows handling of both stationary and non-stationary noise in the same system. Thus, the method provides a single system for several situations, better reduction of interfering noise in audio communications and therefore a higher sound quality.

In a first possible implementation form of the method according to the first aspect, the first set of feature vectors comprises spectral magnitudes of the input signal.

Spectral magnitudes of the input signal can be efficiently processed by an STFT having a low computational complexity.

In a second possible implementation form of the method according to the first aspect as such or according to the first implementation form of the first aspect, the second set of feature vectors is determined by using a background noise estimation technique.

A background noise estimation technique is easy to implement. The power spectrum of noisy speech is equal to the sum of the speech power spectrum and noise power spectrum since speech and background noise are assumed to be independent. In any speech sentence there are pauses between words which do not contain any speech. Those frames will contain only background noise. The noise estimate can be easily updated by tracking those noise-only frames.

In a third possible implementation form of the method according to the first aspect as such or according to any of the preceding implementation forms of the first aspect, the second set of feature vectors is determined for the same time instant as the first set of feature vectors is determined.

When the first and second set of feature vectors are determined for the same time instant, both feature sets are synchronized with respect to each other.

In a fourth possible implementation form of the method according to the first aspect as such or according to any of the preceding implementation forms of the first aspect, the noise weight vector is a unity vector having all its elements set to one.

The case where the noise weight vector is a unity vector is a special case when the background noise is stationary. To reduce the complexity, all weights are imposed being equal to one.

In a fifth possible implementation form of the method according to the first aspect as such or according to any of the preceding implementation forms of the first aspect, the decomposing the input matrix comprises determining an approximate matrix Λ according to:

$$\Lambda = W \cdot H + (\mathbb{1}_{m,1} \cdot h_b) \otimes B,$$

where W denotes the non-negative bases matrix, H denotes the non-negative weight matrix, B denotes the noise matrix, hb denotes the noise vector, $\mathbb{1}_{m,1}$ denotes a column-vector of dimension m containing only ones and the symbol ⊗ denotes the Hadamard product, i.e. element-wise multiplication.

By integrating a background noise estimator into the NMF framework, the estimated noise is considered as a special component in the NMF. That allows handling of both stationary and non-stationary noise in the same system. This same system can be applied for different situations resulting in a better reduction of interfering noise in audio communications and therefore a higher sound quality.

In a sixth possible implementation form of the method according to the first aspect as such or according to any of the preceding implementation forms of the first aspect, the decomposing the input matrix comprises using a cost function for approximating the sum of the first matrix and the second matrix to the input matrix.

By using a cost function iterative or recursive adaptations can be applied which are computational efficient. Decomposition of the input signal and reconstruction of the target signal are improved.

In a seventh possible implementation form of the method according to the sixth implementation form of the first aspect, the decomposing the input matrix comprises optimizing the cost function by using one of multiplicative update rules and gradient-descent algorithms.

Multiplicative update rules are easy to implement and gradient descent algorithms converge to the locally optimum solution.

In an eighth possible implementation form of the method according to the seventh implementation form of the first aspect, the cost function is according to:

$$D = \left\| V \otimes \ln\frac{V}{\Lambda} - V + \Lambda \right\|_1,$$

where V denotes the non-negative input matrix, Λ denotes the approximate matrix according to claim 6, the operation $\|\cdot\|_1$ denotes the Vector 1-norm, the symbol ⊗ denotes the Hadamard product, i.e. element-wise multiplication, and the logarithm and division operations are element-wise.

Such a cost function provides an efficient decomposition and thus noise reduction in the reconstructed signal.

In a ninth possible implementation form of the method according to the seventh implementation form or according to the eighth implementation form of the first aspect, the multiplicative update rules are according to:

$$H = H \otimes \frac{W^T \cdot \frac{V}{\Lambda}}{W^T \cdot \mathbb{1}_{m,n}},\quad W = W \otimes \frac{\frac{V}{\Lambda} \cdot H^T}{\mathbb{1}_{m,n} \cdot H^T},\quad h_b = h_b \otimes \frac{\mathbb{1}_{1,m} \cdot \left(B \otimes \frac{V}{\Lambda}\right)}{\mathbb{1}_{1,m} \cdot B},$$

where W denotes the non-negative bases matrix, H denotes the non-negative weight matrix, B denotes the noise matrix, hb denotes the noise vector, the symbol ⊗ denotes the Hadamard product, i.e. element-wise multiplication, the symbol ⋮ denotes the element-wise division, $\cdot^T$ is the transposition operator and $\mathbb{1}_{m,n}$ and $\mathbb{1}_{1,m}$ are matrices of dimensions m×n and 1×n respectively, whose elements are all equal to one.

These multiplicative update rules are easy to implement and fast converging.

In a tenth possible implementation form of the method according to the first aspect as such or according to any of the preceding implementation forms of the first aspect, the method comprises setting a subset of columns of the non-negative bases matrix to a constant value in accordance with a prior model describing the at least one target signal.

By setting a subset of columns of the non-negative bases matrix to a constant value, computational complexity is reduced.

In an eleventh possible implementation form of the method according to the first aspect as such or according to any of the preceding implementation forms of the first aspect, each base of the non-negative bases matrix represents one of a target signal and noise.

The non-negative bases matrix provides accurate separation of noise components from the speech components which improves the accuracy of the reconstruction.

In a twelfth possible implementation form of the method according to the eleventh implementation form of the first aspect, the reconstructing the at least one target signal comprises combining the base of the non-negative bases matrix representing the at least one target signal and an associated part of the non-negative weight matrix; or combining the base of the non-negative bases matrix representing the at least one target signal, an associated part of the non-negative weight matrix, the non-negative input matrix and the approximate matrix according to the fifth implementation form of the first aspect.

Combining the base of the bases matrix with the associated part of the weight matrix is computationally efficient to perform. An additional combination of that term with the input matrix and the approximate matrix delivers a better reduction of interfering noise and therefore a higher sound quality.

In a thirteenth possible implementation form of the method according to the first aspect as such or according to any of the preceding implementation forms of the first aspect, the at least one target signal is a speech signal.

The method may be applied in speech processing for de-noising the input speech signal.

According to a second aspect, the invention relates to a device for reconstructing at least one target signal corrupted by noise from an input signal, the device comprising means for determining a first set of feature vectors from the input signal, the first set of feature vectors forming a non-negative input matrix representing signal characteristics of the input signal; means for determining a second set of feature vectors from the first set of feature vectors, the second set of feature vectors forming a non-negative noise matrix representing noise characteristics of the input signal; means for decomposing the input matrix into a sum of a first matrix and a second matrix, the first matrix representing a product of a non-negative bases matrix and a non-negative weight matrix, and the second matrix representing a combination of the noise matrix and a noise weight vector; and means for reconstructing the at least one target signal based on the non-negative bases matrix and the non-negative weight matrix.

While the NMF focuses on non-stationary noises, the device according to the second aspect provides an improvement of the speech enhancement quality, compared to both spectral subtraction and NMF. The complexity increase is limited compared to the NMF decomposition.

Aspects of the invention provide a method and a system which uses a modified NMF called Foreground Non-negative Matrix Factorization (FNMF) which integrates a stationary noise estimator into the NMF decomposition process for the reduction of noise in an audio recording.

In the prior art, the used model is described by $V \approx W \cdot H$. This model is extended to:

$$V \approx W \cdot H + (\mathbb{1}_{m,1} \cdot h_b) \otimes B,$$

where the matrix $B \in \mathbb{R}_+^{m \times n}$ is given by the output of a background noise estimation system. Each column of B contains the noise estimate for the same time instance as the corresponding column of V. The vector $h_b \in \mathbb{R}_+^{1 \times n}$ contains non-negative temporal weights and $\mathbb{1}_{m,1}$ is a column-vector of dimension m containing only ones. The symbol $\otimes$ denotes the Hadamard product, i.e. element-wise multiplication.

The objective is then to determine the matrix of spectral bases W, the weight matrix H and the noise weight vector $h_b$ which approximate the input matrix V as precisely as possible.

Intuitively, the stationary part of the interfering noise is captured by the matrix B. Thus, the product W·H, corresponding to the conventional NMF factorization, focuses on the modeling of the "foreground", i.e. the non-stationary sounds. This procedure has two main advantages. The estimate of the stationary noise is more accurate than with the standard NMF, since the noise estimator exploits the stationarity of the background noise. Furthermore, a smaller number of components can be used for the decomposition, resulting in a decrease of complexity of the system.

A variety of cost functions can be used for measuring the reconstruction error. In a preferred implementation form, the cost function D is defined as:

$$D = \left\| V \otimes \ln \frac{V}{\Lambda} - V + \Lambda \right\|_1,$$

$$\text{where } \Lambda = W \cdot H + (\mathbb{1}_{m,1} \cdot h_b) \otimes B,$$

$\|\cdot\|_1$ denotes the Vector 1-norm and $\vdots$ is the element-wise division.

In contrast with the prior art, where the spectral bases constituted by the columns of W are constant over the whole considered spectrogram, the background noise matrix B can be seen as a special basis which evolves over time.

In the preferred implementation form, the optimization of the above defined cost function is performed by multiplicative update rules, which enforces non-negativity without needing explicit constraints:

$$H = H \otimes \frac{W^T \cdot \frac{V}{\Lambda}}{W^T \cdot \mathbb{1}_{m,n}},\ W = W \otimes \frac{\frac{V}{\Lambda} \cdot H^T}{\mathbb{1}_{m,n} \cdot H^T},\ h_b = h_b \otimes \frac{\mathbb{1}_{1,m} \cdot \left(B \otimes \frac{V}{\Lambda}\right)}{\mathbb{1}_{1,m} \cdot B},$$

where $\cdot^T$ is the transposition operator, $\mathbb{1}_{m,n}$ and $\mathbb{1}_{1,m}$ are matrices of dimensions m×n and 1×n respectively, whose elements are all equal to one. In another implementation form, gradient-descent algorithms are used for the optimization. The optimization process stops when convergence is observed or when a sufficient number of iteration has been performed.

If the background noise estimation system is accurate, the matrix B corresponds to the actual stationary part of the noise. In this case, the values of $h_b$ should be close to one. Hence, in an implementation form, these values are constrained to remain in a certain neighborhood around unity. In another implementation form, a reduction of the complexity is achieved by fixing all the values of $h_b$ to one. In this case, neither the matrix multiplication ($\mathbb{1}_{m,1} \cdot h_b$) in the calculation of Λ, nor the update of $h_b$ are needed.

In another implementation form, some of the spectral basis are set to a constant value, fixed by a prior learning. This is beneficial if one of the sources is known and sufficient data is available to estimate the characteristic spectra of this source. In this case, the corresponding columns of W are not updated. The methods wherein the matrix W is entirely constant during the decomposition and the method in which the matrix W is entirely updated are called supervised FNMF and unsupervised FNMF, respectively. In the case where only a part of the spectral basis is updated, the method is called semi-supervised FNMF.

In an implementation form, the initial values of the matrices W, H and $h_b$ which need to be estimated by the FNMF process are set by a random number generator. In another implementation form, the initial values are set according to some prior knowledge of the signal. In particular for an implementation in an on-line system, several decompositions are performed on successive mid-term windows of the signal as shown by C. Joder, F. Weninger, F. Eyben, D. Virette, B. Schuller: "Real-time Speech Separation by Semi-Supervised Nonnegative Matrix Factorization", Proc. of LVA/ICA 2012, Springer, p. 322-329. Then, a faster convergence is obtained by initializing the matrices according to the output of the previous decomposition.

The methods, systems and devices described herein may be implemented as software in a Digital Signal Processor (DSP), in a micro-controller or in any other side-processor or as hardware circuit within an application specific integrated circuit (ASIC).

The invention can be implemented in digital electronic circuitry, or in computer hardware, firmware, software, or in combinations thereof, e.g. in available hardware of conventional mobile devices or in new hardware dedicated for processing the audio enhancement system.

BRIEF DESCRIPTION OF THE DRAWINGS

Further embodiments of the invention will be described with respect to the following figures, in which.

DETAILED DESCRIPTION

Figure 1:
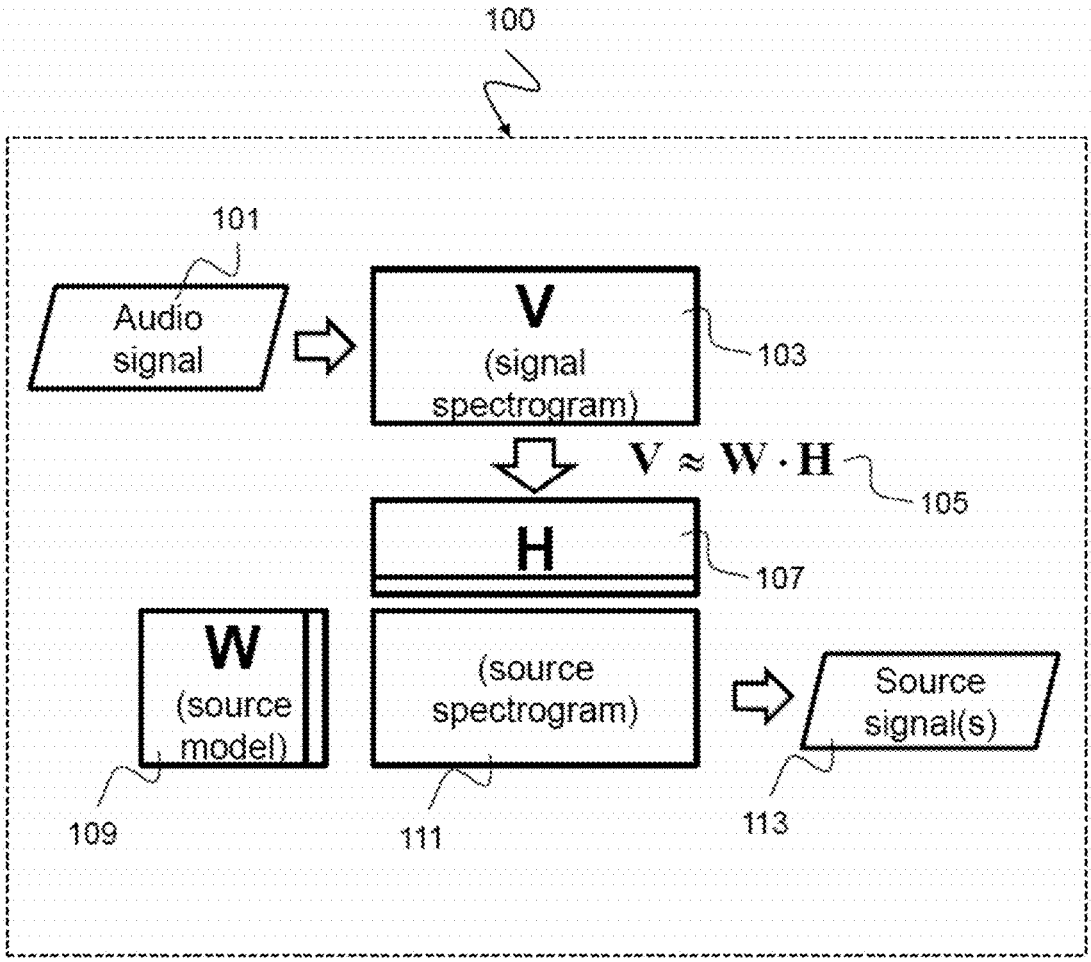
FIG. 1 shows a schematic diagram of a conventional NMF technique.
Figure 2:
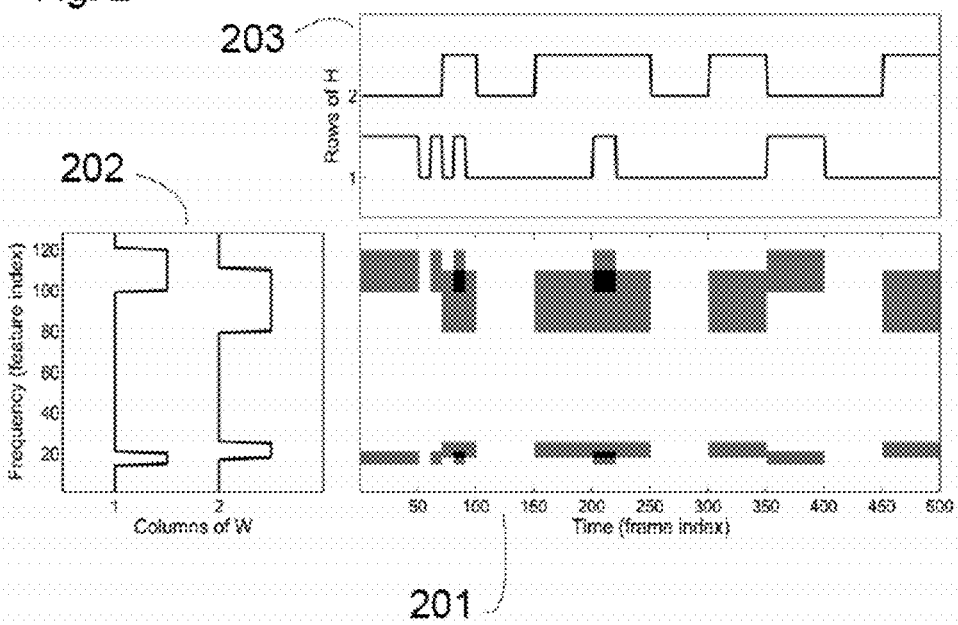
FIG. 2 shows three schematic diagrams representing V, W and H matrices of a conventional NMF decomposition.
Figure 3:
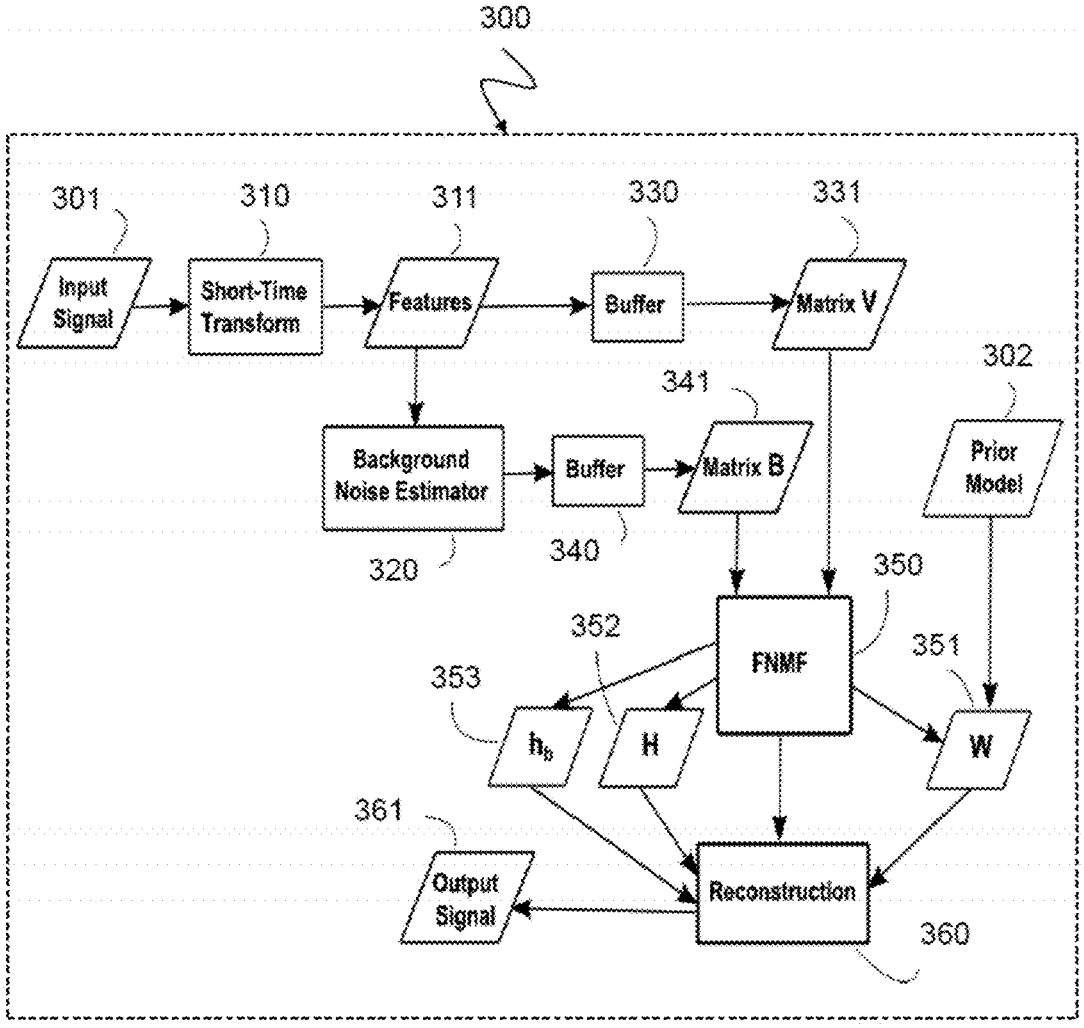
FIG. 3 shows a schematic diagram of a system for reconstructing at least one target signal from an input signal corrupted by noise according to an implementation form.

FIG. 3 shows a schematic diagram of a system 300 for reconstructing at least one target signal from an input signal corrupted by noise according to an implementation form.

The system 300 comprises a short-time transform module 310, a background noise estimator 320, two buffers 330 and 340, a FNMF module 350 and a reconstruction module 360. A digital single-channel input signal 301, corresponding to a recording of a signal of interest, for example speech, corrupted by noise, is input to the short-time transform module 310 which performs a windowing into short-time frames and a transform, so as to produce non-negative feature vectors 311. A buffer 330 stores these features in order to produce the matrix V 331.

The features 311 are also processed by the background noise estimator 320 which outputs, for each feature vector, an estimate of the background acoustic noise. These estimates are stored by the buffer 340, to create the matrix B 341. The FNMF module 350 then performs a decomposition of the matrix V 331, representing the magnitude spectra of the input signal. The output matrices W 351 and H 352 represent respectively the feature bases and the corresponding weights for describing the non-stationary sounds of the input signal. The vector $h_b$ 353 contains the weights of the background noise estimate.

In this FNMF decomposition, the spectral bases which describe the speech signal are set by a prior model 302. The FNMF module only updates the spectral bases corresponding to the non-stationary noise.

A reconstruction 360 is performed based on the result of the decomposition, in order to obtain the output signal 361, in which the noise has been reduced. In this example, the reconstruction exploits a so-called "soft mask" approach. $W^S$ is defined as the matrix of spectral bases describing the speech, given by the prior model, and $H^S$ is defined as the matrix of corresponding weights, extracted from the matrix H. The magnitude spectrogram S of the output signal is calculated as:

$$S = \frac{W^s \cdot H^s}{\Lambda} \otimes V.$$

The time-domain signal is then obtained by a standard approach, involving an inverse Fourier transform exploiting the phase of the original complex spectrogram, followed by an overlap-add procedure.

In another implementation form, the spectrogram of the output signal is directly reconstructed as $S=W^S \cdot H^S$. In yet other implementation forms, conventional speech enhancement methods such as the so-called Minimum Mean-Square Error Log-Spectral Amplitude Estimator (MMSE-LSA) are exploited, in which the estimation of the noise magnitude spectrum is given by $N=\Lambda-S$.

In another implementation form, several audio sources in a recording corrupted by noise are separated. In such an implementation form, the reconstruction of each source is performed by first identifying the spectral bases associated to the source, and then calculating the magnitude spectrogram according to the above described methods.

The components of the system 300 described above may also be implemented as steps of a method.

Figure 4:
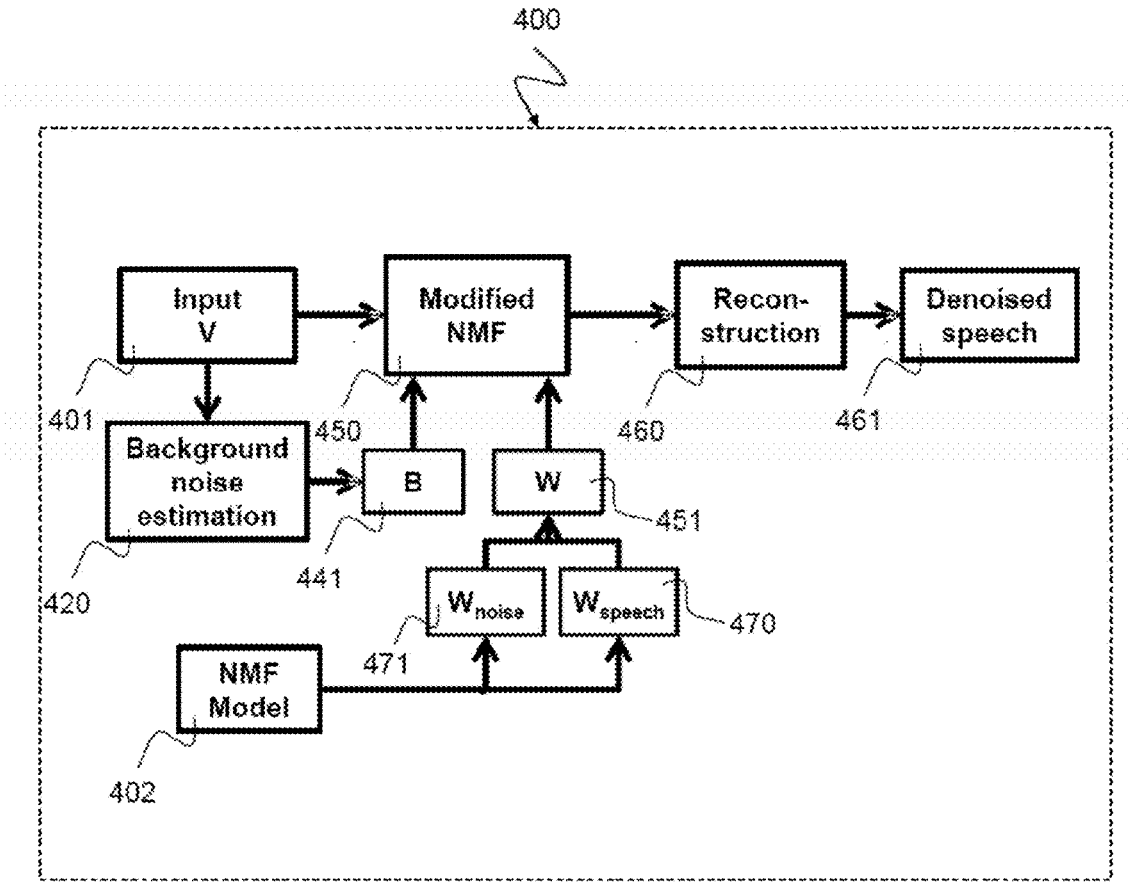
FIG. 4 shows a schematic diagram of a method for reconstructing at least one target signal from an input signal corrupted by noise according to an implementation form.

FIG. 4 shows a schematic diagram of a method 400 for reconstructing at least one target signal from an input signal corrupted by noise according to an implementation form.

In the method 400, background noise B 441 is estimated from a noisy input matrix V 401. The spectral bases Wnoise 471 and Wspeech 470 are given by an NMF model, e.g. by prior training or estimation from the signal. The spectral bases Wnoise 471 and Wspeech 470 are combined in the spectral basis W 451. A modified NMF 450 is performed to estimate the weights of the basis combination. The signal 461 is reconstructed 460 based on the result of the modified NMF decomposition 450. The modified NMF 450 considers B 441 as a special, time-varying component.

In an implementation form, the method 400 comprises determining a first set of feature vectors from the input signal, the first set of feature vectors forming a non-negative input matrix V 401 representing signal characteristics of the input signal. The method 400 comprises determining a second set of feature vectors from the first set of feature vectors, the second set of feature vectors are forming a non-negative noise matrix B 441 representing noise characteristics of the input signal. Background noise estimation 420 is used for determining the second set of feature vectors. The method 400 further comprises decomposing the input matrix V 401 into a sum of a first matrix and a second matrix, the first matrix representing a product of a non-negative bases matrix W 451 and a non-negative weight matrix H (not depicted in FIG. 4), and the second matrix representing a combination of the noise matrix B 441 and a noise weight vector hb (not depicted in FIG. 4). The decomposing is performed by a modified NMF 450 which may correspond to the FNMF module 350 as described with respect to FIG. 3. The non-negative bases matrix W 451 is based on an NMF model 402 which uses a noise component Wnoise 471 model and a speech component Wspeech 470 model for modeling the bases matrix W 451.

The method 400 further comprises reconstructing 460 the at least one target signal as de-noised speech 461 based on the non-negative bases matrix W and the non-negative weight matrix H.

The method 400 provides a hybrid approach that integrates a background noise estimator into the NMF framework. The estimated noise is considered as a special component in the NMF. That allows handling of both stationary and non-stationary noise in the same system. While the NMF focuses on non-stationary noises, the method 400 provides an improvement of the speech enhancement quality, compared to both spectral subtraction and NMF. The complexity increase is limited compared to NMF.

Thus, the method 400 provides a single system for several situations, better reduction of interfering noise in audio communications and therefore a higher sound quality.

In an implementation form, the method 400 is used for separating a target signal, e.g. a noise signal from a noisy sound in which the stationary part of the noise is estimated on its own and the non-stationary part is estimated by NMF. In an implementation form, the stationary noise estimate is used as a time-varying component in the NMF estimation. In an implementation form, both target and speech bases used by the NMF are learned in a prior training phase. In an implementation form, only the target basis are learned, and the noise basis is estimated on the mixture signal.

Figure 5:
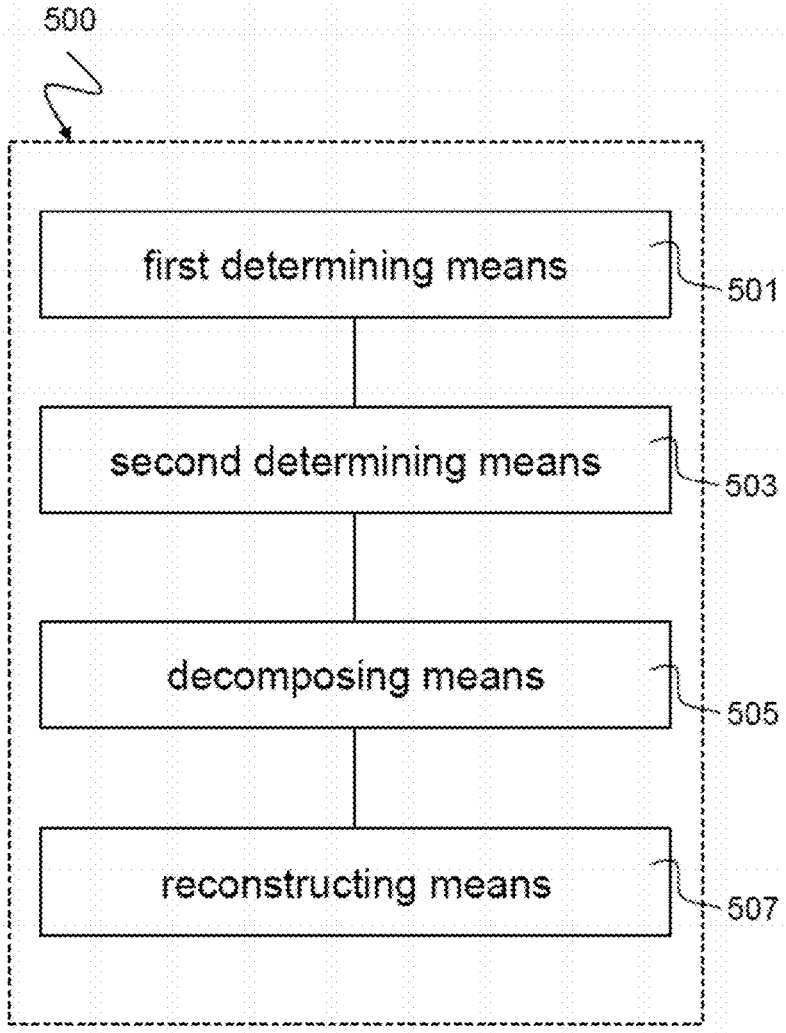
FIG. 5 shows a block diagram of a device for reconstructing at least one target signal from an input signal corrupted by noise according to an implementation form.

FIG. 5 shows a block diagram of a device 500 for reconstructing at least one target signal from an input signal corrupted by noise according to an implementation form.

The device 500 comprises means 501 for determining a first set of feature vectors from the input signal, the first set of feature vectors forming a non-negative input matrix V representing signal characteristics of the input signal. The device 500 comprises means 503 for determining a second set of feature vectors from the first set of feature vectors, wherein the second set of feature vectors are forming a non-negative noise matrix B representing noise characteristics of the input signal. The device 500 comprises means 505 for decomposing the input matrix V into a sum of a first matrix and a second matrix, the first matrix representing a product of a non-negative bases matrix W and a non-negative weight matrix H, and the second matrix representing a combination of the noise matrix B and a noise weight vector hb. The device 500 comprises means 507 for reconstructing the at least one target signal based on the non-negative bases matrix W and the non-negative weight matrix H.

In an implementation form, the device 500 comprises a buffer to store an input non-negative matrix representing the input signal, the columns of the input non-negative matrix representing features of the input signal at different instances in time. The first determining means 501 is used for determining these features of the input signal. The second determining means 503 is used for estimating the features corresponding to the stationary part of the corrupting noise. The device further comprises a buffer to store a background non-negative matrix, the columns of which representing features of the stationary part of the corrupting noise at the same instances in time as the preceding buffer. The decomposing means 505 is used for decomposing the input non-negative matrix into a sum of two terms, where one term is the product of a non-negative base matrix and a non-negative weight matrix, and the second term is obtained by multiplying each column of the background non-negative matrix by a non-negative weight.

In an implementation form, the non-negative weights are equal to unity.

In an implementation form, the input non-negative matrix is V, the non-negative base matrix is W, the non-negative weight matrix is H, the background non-negative matrix is B and the row-vector containing the non-negative weights is $h_b$.

In an implementation form, the device 500 further comprises means to calculate an approximate matrix:

$$\Lambda = W \cdot H + (\mathbb{1}_{m,1} \cdot h_b) \otimes B.$$

In an implementation form, the factorisation of the approximate matrix is performed by minimising a divergence function between the input non-negative matrix V and the approximate matrix.

In an implementation form, the divergence function to be minimised is:

$$D = \left\| V \otimes \ln \frac{V}{\Lambda} - V + \Lambda \right\|_1.$$

In an implementation form, the device further comprises means for updating the decomposition according to:

$$H = H \otimes \frac{W^T \cdot \frac{V}{\Lambda}}{W^T \cdot \mathbb{1}_{m,n}},\ W = W \otimes \frac{\frac{V}{\Lambda} \cdot H^T}{\mathbb{1}_{m,n} \cdot H^T},\ h_b = h_b \otimes \frac{\mathbb{1}_{1,m} \cdot \left(B \otimes \frac{V}{\Lambda}\right)}{\mathbb{1}_{1,m} \cdot B}.$$

In an implementation form, each basis of the non-negative bases matrix is associated to one of the target signals or to noise.

In an implementation form, the matrix which contains the features representing each target signal is reconstructed by combining its associated bases, the corresponding weights, the input non-negative matrix and the approximate matrix.

In an implementation form, some columns of the non-negative base matrix are fixed to a constant value according to a prior model.

In an implementation form, the target signal is speech, respectively a speech signal.

From the foregoing, it will be apparent to those skilled in the art that a variety of methods, systems, computer programs on recording media, and the like, are provided.

The present disclosure also supports a computer program product including computer executable code or computer executable instructions that, when executed, causes at least one computer to execute the performing and computing steps described herein.

The present disclosure also supports a system configured to execute the performing and computing steps described herein.

Many alternatives, modifications, and variations will be apparent to those skilled in the art in light of the above teachings. Of course, those skilled in the art readily recognize that there are numerous applications of the invention beyond those described herein. While the present inventions has been described with reference to one or more particular embodiments, those skilled in the art recognize that many changes may be made thereto without departing from the spirit and scope of the present invention. It is therefore to be understood that within the scope of the appended claims and their equivalents, the inventions may be practiced otherwise than as specifically described herein.

What is claimed is:

1. A method for reconstructing at least one target signal from an input signal corrupted by noise, the method comprising:

determining a first set of feature vectors from the input signal, the first set of feature vectors forming a non-negative input matrix representing signal characteristics of the input signal;

determining a second set of feature vectors from the first set of feature vectors, the second set of feature vectors forming a non-negative noise matrix representing noise characteristics of the input signal;

decomposing the input matrix into a sum of a first matrix and a second matrix, the first matrix representing a product of a non-negative bases matrix and a non-negative weight matrix, and the second matrix representing a combination of the noise matrix and a noise weight vector; and reconstructing the at least one target signal based on the non-negative bases matrix and the non-negative weight matrix, wherein the noise weight vector is a unity vector having all elements set to one, and wherein the at least one target signal is a speech signal.

2. The method of claim 1, wherein the first set of feature vectors comprises spectral magnitudes of the input signal.

3. The method of claim 1, wherein the second set of feature vectors is determined by using a background noise estimation technique.

4. The method of claim 1, wherein the second set of feature vectors is determined for the same time instant as the first set of feature vectors is determined.

5. The method of claim 1, wherein decomposing the input matrix comprises:

determining an approximate matrix Λ according to:

$$\Lambda = W \cdot H + (\mathbb{I}_{m,1} \cdot h_b) \otimes B,$$

where W denotes the non-negative bases matrix, H denotes the non-negative weight matrix, B denotes the noise matrix, $h_b$ denotes the noise vector, $\mathbb{I}_{m,1}$ denotes a column-vector of dimension m containing only ones, and the symbol ⊗ denotes the Hadamard product with element-wise multiplication.

6. The method of claim 1, wherein decomposing the input matrix comprises using a cost function for approximating the sum of the first matrix and the second matrix to the input matrix.

7. The method of claim 6, wherein decomposing the input matrix comprises optimizing the cost function by using one of multiplicative update rules and gradient-descent algorithms.

8. The method of claim 7, wherein the multiplicative update rules are according to:

$$H = H \otimes \frac{W^T \cdot \frac{V}{\Lambda}}{W^T \cdot \mathbb{I}_{m,n}},\ W = W \otimes \frac{\frac{V}{\Lambda} \cdot H^T}{\mathbb{I}_{m,n} \cdot H^T},\ h_b = h_b \otimes \frac{\mathbb{I}_{1,m} \cdot \left(B \otimes \frac{V}{\Lambda}\right)}{\mathbb{I}_{1,m} \cdot B},$$

where W denotes the non-negative bases matrix, H denotes the non-negative weight matrix, B denotes the noise matrix, $h_b$ denotes the noise vector, the symbol ⊗ denotes the Hadamard product with element-wise multiplication, the symbol ⋮ denotes the element-wise division, $\cdot^T$ is the transposition operator and $\mathbb{I}_{m,n}$ and $\mathbb{I}_{1,m}$ are matrices of dimensions m×n and 1×n respectively, whose elements are all equal to one.

9. The method of claim 1, comprising setting a subset of columns of the non-negative bases matrix to a constant value in accordance with a prior model describing the at least one target signal.

10. The method of claim 1, wherein each base of the non-negative bases matrix represents one of a target signal and noise.

11. The method of claim 10, wherein reconstructing the at least one target signal comprises combining the base of the non-negative bases matrix representing the at least one target signal and an associated part of the non-negative weight matrix.

12. The method of claim 10, wherein reconstructing the at least one target signal comprises combining the base of the non-negative bases matrix representing the at least one target signal, an associated part of the non-negative eight matrix, the non-negative input matrix, and an approximate matrix Λ.

13. A method for reconstructing at least one target signal from an input signal corrupted by noise, the method comprising:

determining a first set of feature vectors from the input signal, the first set of feature vectors forming a non-negative input matrix representing signal characteristics of the input signal;

determining a second set of feature vectors from the first set of feature vectors, the second set of feature vectors forming a non-negative noise matrix representing noise characteristics of the input signal;

decomposing the input matrix into a sum of a first matrix and a second matrix, the first matrix representing a product of a non-negative bases matrix and a non-negative weight matrix, and the second matrix representing a combination of the noise matrix and a noise weight vector; and reconstructing the at least one target signal based on the non-negative bases matrix and the non-negative weight matrix, wherein decomposing the input matrix comprises:

determining an approximate matrix Λ according to:

$$\Lambda = W \cdot H + (\mathbb{I}_{m,1} \cdot h_b) \otimes B,$$

where W denotes the non-negative bases matrix, H denotes the non-negative weight matrix, B denotes the noise matrix, $h_b$ denotes the noise vector, $\mathbb{I}_{m,1}$ denotes a column-vector of dimension m containing only ones, and the symbol ⊗ denotes the Hadamard product with element-wise multiplication, and wherein the at least one target signal is a speech signal.

14. A method for reconstructing at least one target signal from an input signal corrupted by noise, the method comprising:

determining a first set of feature vectors from the input signal, the first set of feature vectors forming a non-negative input matrix representing signal characteristics of the input signal;

determining a second set of feature vectors from the first set of feature vectors, the second set of feature vectors forming a non-negative noise matrix representing noise characteristics of the input signal;

decomposing the input matrix into a sum of a first matrix and a second matrix, the first matrix representing a product of a non-negative bases matrix and a non-negative weight matrix, and the second matrix representing a combination of the noise matrix and a noise weight vector; and reconstructing the at least one target signal based on the non-negative bases matrix and the non-negative weight matrix, wherein decomposing the input matrix comprises using a cost function for approximating the sum of the first matrix and the second matrix to the input matrix, wherein decomposing the input matrix comprises optimizing the cost function by using one of multiplicative update rules and gradient-descent algorithms, wherein the multiplicative update rules are according to:

$$H = H \otimes \frac{W^{\mathbb{I}} \cdot \frac{V}{\Lambda}}{W^{\mathbb{I}} \cdot \mathbb{I}_{m,n}},\ W = W \otimes \frac{\frac{V}{\Lambda} \cdot H^{\mathbb{I}}}{\mathbb{I}_{m,n} \cdot H^{\mathbb{I}}},$$

$$h_b = h_b \otimes \frac{\mathbb{I}_{1,m} \cdot \left(B \otimes \frac{V}{\Lambda}\right)}{\mathbb{I}_{1,m} \cdot B},$$

where W denotes the non-negative bases matrix, H denotes the non-negative weight matrix, B denotes the noise matrix, $h_b$ denotes the noise vector, the symbol ⊗ denotes the Hadamard product with element-wise multiplication, the symbol ⋮ denotes the element-wise division, ·τ is the transposition operator and $\mathbb{I}_{m,n}$ and z,62 $_{1,m}$ are matrices of dimensions m×n and 1×n respectively, whose elements are all equal to one, and wherein the at least one target signal is a speech signal.

15. A device for reconstructing at least one target signal from an input signal corrupted by noise, the device comprising:

a non-transitory computer readable medium having instructions stored thereon; and a computer processor coupled to the non-transitory computer readable medium and configured to execute the instructions to:

determine a first set of feature vectors from the input signal, the first set of feature vectors forming a non-negative input matrix representing signal characteristics of the input signal;

determine a second set of feature vectors from the first set of feature vectors, the second set of feature vectors forming a non-negative noise matrix representing noise characteristics of the input signal;

decompose the input matrix into a sum of a first matrix and a second matrix, the first matrix representing a product of a non-negative bases matrix and a non-negative weight matrix, and the second matrix representing a combination of the noise matrix and a noise weight vector; and reconstruct the at least one target signal based on the non-negative bases matrix and the non-negative weight matrix, wherein the noise weight vector is a unity vector having all elements set to one, and wherein the at least one target signal is a speech signal.

16. A device for reconstructing at least one target signal from an input signal corrupted by noise, the device comprising:

a non-transitory computer readable medium having instructions stored thereon; and a computer processor coupled to the non-transitory computer readable medium and configured to execute the instructions to:

determine a first set of feature vectors from the input signal, the first set of feature vectors forming a non-negative input matrix representing signal characteristics of the input signal;

determine a second set of feature vectors from the first set of feature vectors, the second set of feature vectors forming a non-negative noise matrix representing noise characteristics of the input signal;

decompose the input matrix into a sum of a first matrix and a second matrix, the first matrix representing a product of a non-negative bases matrix and a non-negative weight matrix, and the second matrix representing a combination of the noise matrix and a noise weight vector; and reconstruct the at least one target signal based on the non-negative bases matrix and the non-negative weight matrix, wherein decomposing the input matrix comprises:

determining an approximate matrix Λaccording to:

$$\Lambda = W \cdot H + (\mathbb{I}_{m,1} \cdot h_b) \otimes B,$$

where W denotes the non-negative bases matrix, H denotes the non-negative weight matrix, B denotes the noise matrix, $h_h$ denotes the noise vector, $\mathbb{I}_{m,1}$ denotes a column-vector of dimension m containing only ones, and the symbol ⊗ denotes the Hadamard product with element-wise multiplication, and wherein the at least one target signal is a speech signal.

17. A device for reconstructing at least one target signal from an input signal corrupted by noise, the device comprising:

a non-transitory computer readable medium having instructions stored thereon; and a computer processor coupled to the non-transitory computer readable medium and configured to execute the instructions to:

determine a first set of feature vectors from the input signal, the first set of feature vectors forming a non-negative input matrix representing signal characteristics of the input signal;

determine a second set of feature vectors from the first set of feature vectors, the second set of feature vectors forming a non-negative noise matrix representing noise characteristics of the input signal;

decompose the input matrix into a sum of a first matrix and a second matrix, the first matrix representing a product of a non-negative bases matrix and a non-negative weight matrix, and the second matrix representing a combination of the noise matrix and a noise weight vector; and reconstruct the at least one target signal based on the non-negative bases matrix and the non-negative weight matrix, wherein decomposing the input matrix comprises using a cost function for approximating the sum of the first matrix and the second matrix to the input matrix, wherein decomposing the input matrix comprises optimizing the cost function by using one of multiplicative update rules and gradient-descent algorithms, wherein the multiplicative update rules are according to:

$$H = H \otimes \frac{W^{\mathbb{I}} \cdot \frac{V}{\Lambda}}{W^{\mathbb{I}} \cdot \mathbb{I}_{m,n}}, \quad W = W \otimes \frac{\frac{V}{\Lambda} \cdot H^{\mathbb{I}}}{\mathbb{I}_{m,n} \cdot H^{\mathbb{I}}},$$

$$h_b = h_b \otimes \frac{\mathbb{I}_{1,m} \cdot \left(B \otimes \frac{V}{\Lambda}\right)}{\mathbb{I}_{1,m} \cdot B},$$

where W denotes the non-negative bases matrix, H denotes the non-negative weight matrix, B denotes the noise matrix, $_b$ denotes the noise vector, the symbol ⊗ denotes the Hadamard product with element-wise multiplication, the symbol ⋮ denotes the element-wise division, $\cdot^{\mathbb{T}}$ is the transposition operator and $\mathbb{I}_{m,n}$ and $\mathbb{I}_{1,m}$ are matrices of dimensions m×n and 1×n respectively, whose elements are all equal to one, and wherein the at least one target signal is a speech signal.

* * * * *